US006035543A

United States Patent [19]

Carlyle

[11] Patent Number: 6,035,543

[45] Date of Patent: Mar. 14, 2000

[54] JET VENTILATED CONVEYOR TRAY

[76] Inventor: Allan M. Carlyle, 5587 Heather Street, Vancouver, British Columbia, Canada, V5Z 3N3

[21] Appl. No.: 09/049,547

[22] Filed: Mar. 27, 1998

[51] Int. Cl.[7] ..... F26B 9/00

[52] U.S. Cl. ..... 34/164; 34/171; 34/195; 34/237; 34/238

[58] Field of Search ..... 34/164, 171, 172, 34/174, 178, 184, 192, 193, 195, 236, 237, 238; 198/768, 761

[56] References Cited

U.S. PATENT DOCUMENTS

| | | | |
|---|---|---|---|
| 3,996,032 | 12/1976 | McWilliams et al. | 34/164 X |
| 4,024,288 | 5/1977 | Witte | 426/461 |
| 4,024,647 | 5/1977 | Schaefer | 34/380 |
| 4,215,488 | 8/1980 | Donabedian | 34/238 |
| 4,237,622 | 12/1980 | Francis | 34/147 |
| 4,744,714 | 5/1988 | Cross et al. | 414/304 |
| 4,779,523 | 10/1988 | Hiroshima | 99/404 |
| 4,781,403 | 11/1988 | Durnil | 285/94 |
| 4,875,343 | 10/1989 | Jeppsson | 62/381 |
| 4,948,321 | 8/1990 | Wilding et al. | 414/288 |
| 5,161,548 | 11/1992 | Neville | 131/296 |
| 5,653,004 | 8/1997 | Thom, Jr. | 34/238 X |

*Primary Examiner*—Stephen Gravini
*Attorney, Agent, or Firm*—Fulbright & Jaworski L.L.P.

[57] ABSTRACT

Jet ventilated trays for a fluidizer conveyor for processing particulate material permit gas to pass up through slots between the slats, and sufficient gas passes through the slots to prevent fine particles falling through the trays. The ventilated tray has a plurality of slats arranged transversely to the direction of travel of the particulate material on the conveyor, adjacent slats overlap in the direction of travel leaving longitudinal slots at leading edges of top slats for gas flow therethrough. The use of a wet particulate material on the tray allows scrubbing and filtering applications.

8 Claims, 4 Drawing Sheets

JET VENTILATED CONVEYOR TRAY

FIELD OF THE INVENTION

The present invention relates to a vibrating conveyor for drying, filtering and reacting with a fluidized bed of particulate material. More specifically, the present invention provides a jet ventilated tray for a vibrating or fluidizing conveyor for a process gas to pass through the tray.

DESCRIPTION OF RELATED ART

Shaker or vibratory conveyors are commonly used for drying particulate material. In most cases the process gas passes over the surface of the particulate material and in other cases the gas passes through perforations in the conveyor tray and then through the bed of particulate material. An example of this last case is U.S. Pat. No. 5,161,548 which shows gas passing up through perforations in a conveyor. The nature of the particulate material must be taken into consideration with the perforation design. Loss of some particulate material occurs if the conveyor tray is perforated with openings larger than the smallest particle. Some designs use a screen for the tray bottom, others rely on the velocity of the gas up through the tray perforations to prevent particles from dropping through.

The act of conveying the particulate material may be a pusher or a drag mechanism. Some designs use vibrations. An example of a helical vibratory conveyor is shown in my co-pending U.S. patent application Ser. No. 08/680,088. In this type of conveyor the direction and velocity of the gas may assist the progress of the material. Furthermore, one is able to vary the amplitude of vibration, the frequency of vibration and the angle of vibration to suit different particulate material being conveyed.

Examples of other helical conveying systems, primarily dryers, are shown in U.S. Pat. Nos. 4,237,622 and 4,875,343.

SUMMARY OF THE INVENTION

It is an aim of the present invention to provide jet ventilated conveyor trays which may be assembled into a conveyor that reduces or substantially eliminates the loss of fine particles through openings in the tray and also directs the flow of gas through the tray openings in the direction of material flow. When the bed of fine particles resting on the tray is vibrated to fluidize the particulate bed, the gas flows up freely through this bed. The velocity of the gas through the bed of particulate material must be adjusted to establish the retention required to effect the necessary mass transfer but avoids any particulate matter being carried away in the gas stream.

The jet ventilated tray of the present invention is primarily to be used with vibrating or fluidizing conveyors. The tray comprises a plurality of slats arranged to overlap in a manner to result in a slot along the leading edge of the top slat. Each slot directs gas in the same direction as the flow of particulate material. The number of slots is determined by the width of the slats, the conveyor length and the required gas flow through the particulate material. The length of the slot is equal to the length of the slat and the volume of gas through the slot is a function of the slat length, the vertical height of the slot and the gas flow and pressure. The dimensions of the slot are designed to apply to any particular application as well as gas pressure, velocity and volume. In one embodiment the slat overlap is normally one-quarter of the narrowest width of the slat. The slats for straight conveyors are fabricated as parallel components and the slats for curved conveyors are fabricated as tapered components and arranged helically or curved.

The present invention provides a jet ventilated tray for a particulate material conveyor comprising a plurality of slats arranged transversely to the direction of travel of the particulate material on the conveyor, adjacent slats overlapping in the direction of travel leaving longitudinal slots at leading edges of top slats for gas flow therethrough.

In a vibratory conveyor such as that shown in my co-pending U.S. patent application Ser. No. 08/680,088 the vibrations are controlled for frequency, amplitude and vector to produce the required degree of fluidization, material velocity and direction. The particulate material may be fed onto the conveyor at a controlled rate. In non-vibrating conveyors particulate material may be carried, pushed or pulled on conveyor chains to provide a means of travel.

Liquid sprays may be used for wetting the particulate material. Such sprays are positioned above the conveyor. In other embodiments a fluidized bed is comprised of inert material and wetted with a reagent to remove a component of a gas by scrubbing. In other embodiments liquid/gaseous reactions are conducted and the resulting chemical products removed in separate operations. Similarly, in other processes reactions occur between particulate material and gases. A bed of inert wet or dry particles may also be used to filter fine particulate matter from a gas stream. A combination filter/scrubber operation can be conducted with a suitable liquid reagent. Such a filter/scrubber operation is typical for boiler flue gas.

The jet ventilated tray of the present invention is applicable to all of these applications since it reduces or substantially eliminates fine particle loss and hence increases overall efficiency.

BRIEF DESCRIPTION OF THE DRAWINGS

In drawings which illustrate embodiments of the present invention.

DESCRIPTION OF THE PREFERRED EMBODIMENTS

Figure 1:
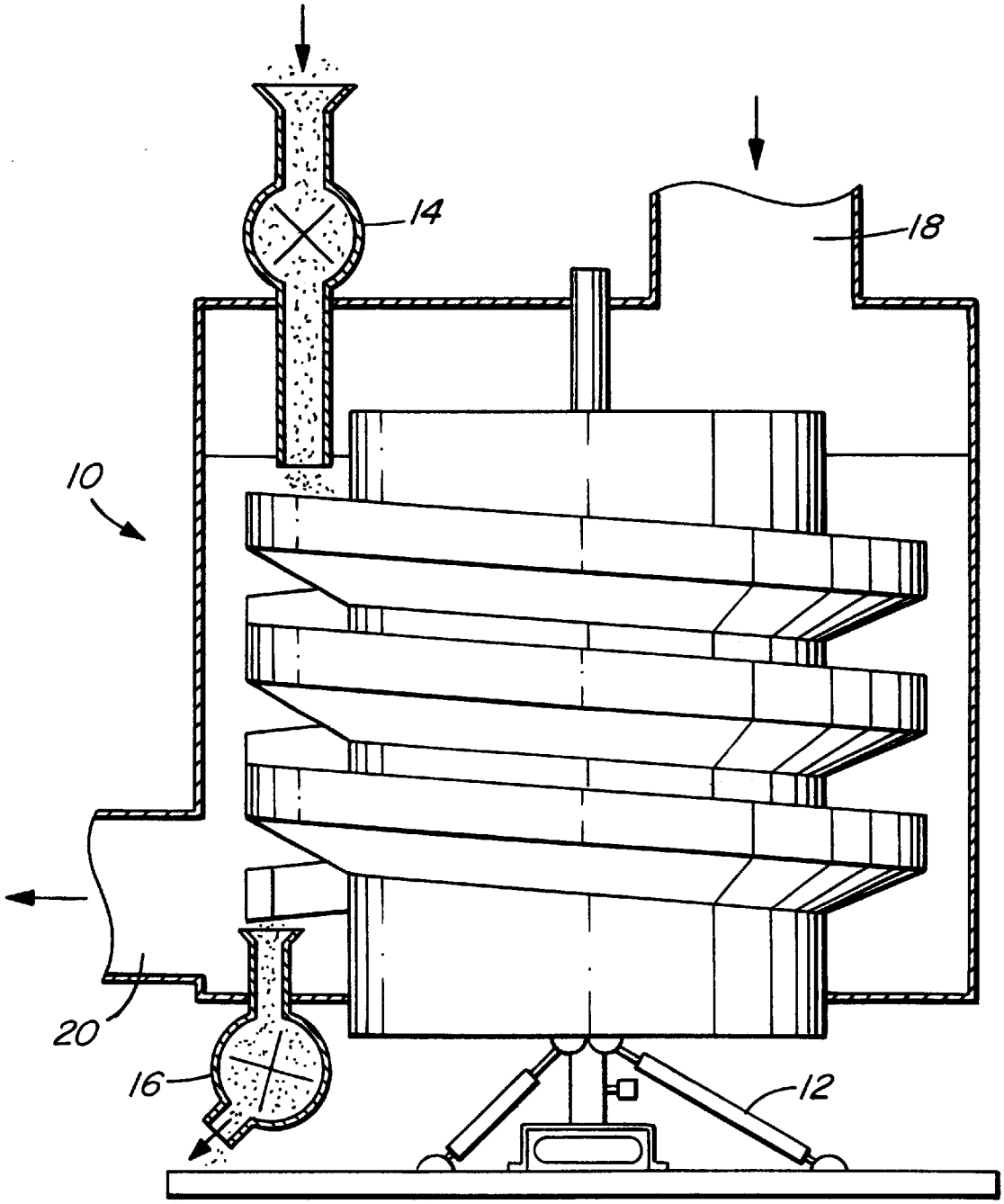
FIG. 1 PRIOR ART
FIG. 1 shows a vibratory or fluidizing helical conveyor of the type known in the prior art and specifically in the type known in my co-pending U.S. patent application Ser. No. 08/680,088.

A typical helical vibratory or fluidizing conveyor 10 is shown in FIG. 1 mounted for vibration by means of vibrators 12 and having an input feeder 14 and output feeder 16 to control the flow of particulate material in the conveyor 10. A gas inlet 18 and gas outlet 20 are provided to supply gas for drying or filtering the particulate material. The manner the gas is applied to the material will be described hereafter.

Figure 2:
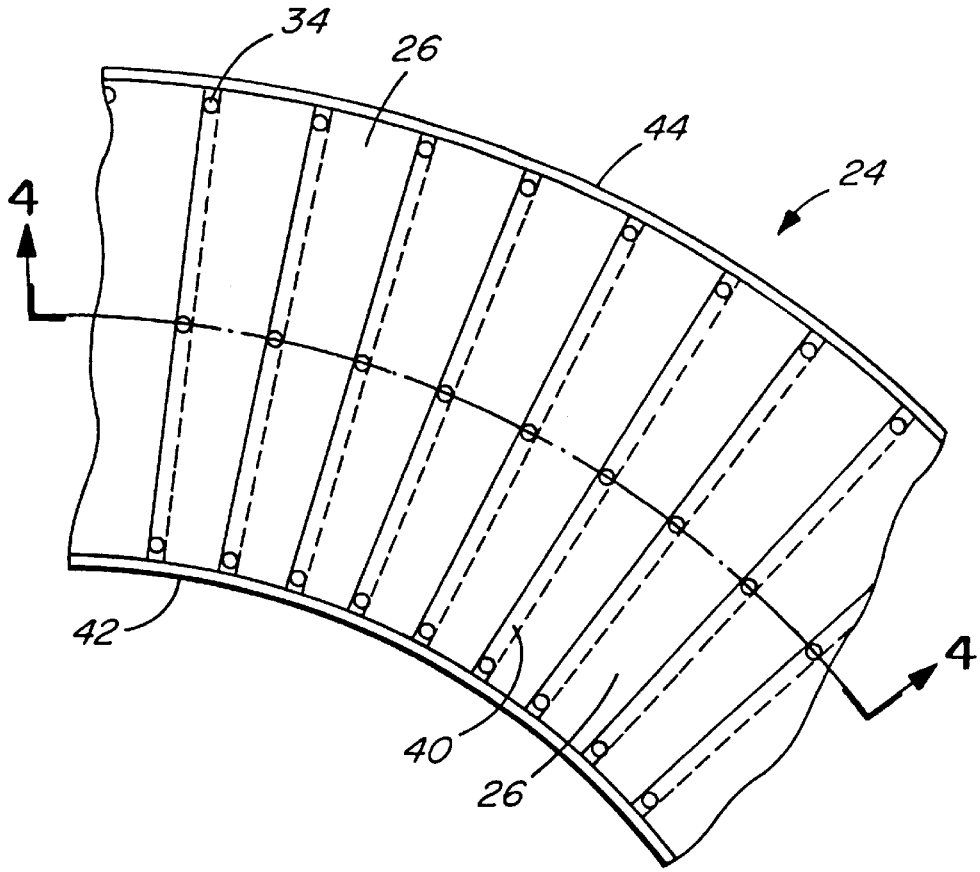
FIG. 2 is a plan view showing an assembly of tapered slats according to one embodiment of the present invention assembled into a curved conveyor.
Figure 3:
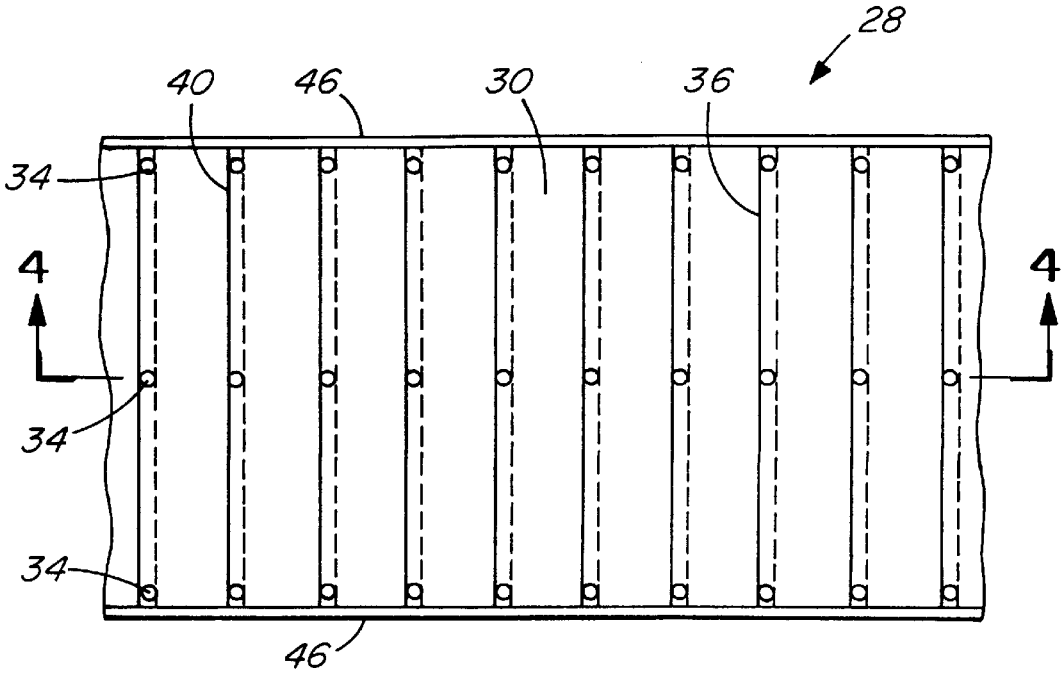
FIG. 3 is a plan view showing an assembly of parallel slats according to another embodiment of the present invention for a straight conveyor.
Figure 4:
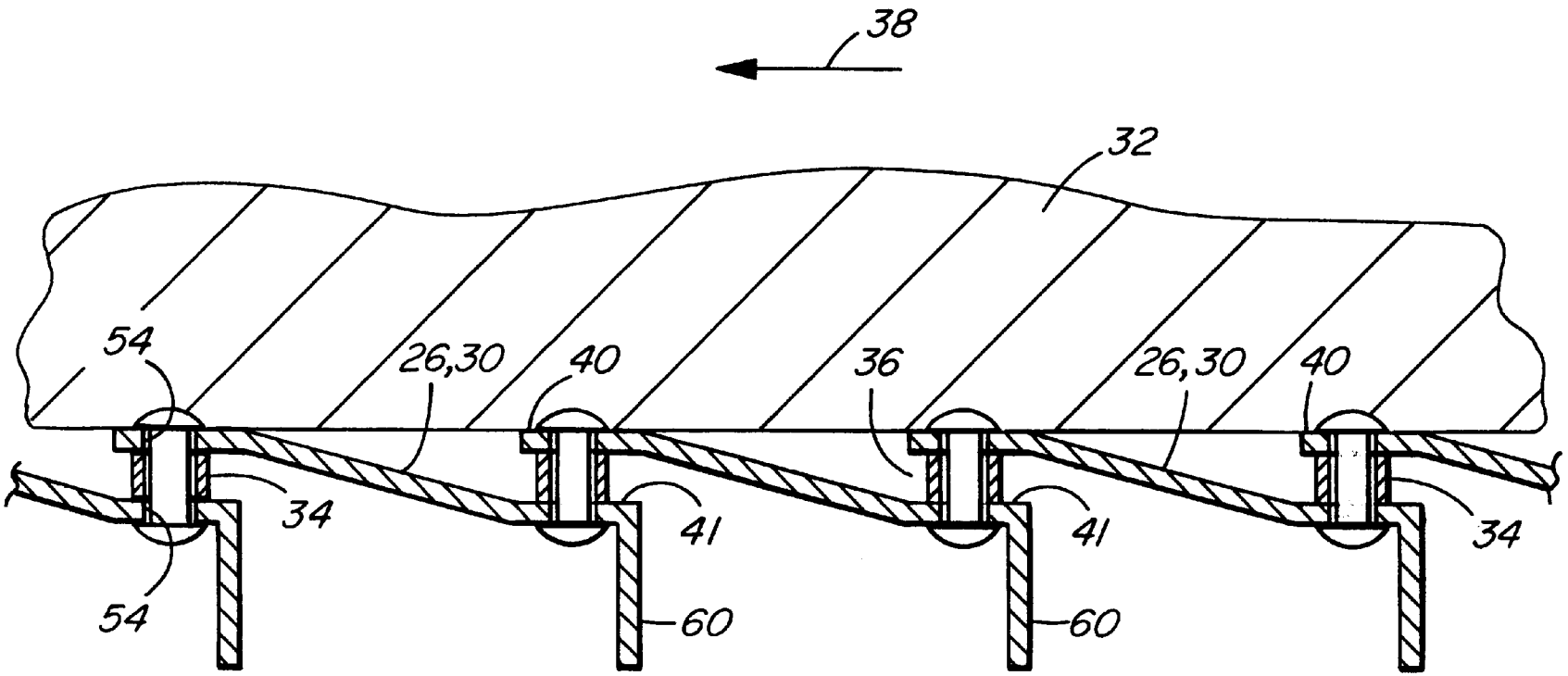
FIG. 4 is a sectional view taken along line 4—4 of FIGS. 2 and 3 showing a cross-section of a plurality of slats with particulate material on a conveyor.

As shown in FIG. 2, a helical or curved conveyor tray 24 comprises a plurality of tapered slats 26 arranged radially. A straight conveyor 28 is shown in FIG. 3 with parallel slats 30 arranged in a parallel configuration. As shown in FIG. 4, the slats 26,30 are arranged so each leading edge overlaps the trailing edge of the adjacent slat and thus supports the particulate material 32. Spacers 34 are provided at the leading edge of the top slat 26,30 resting on the trailing edge of the bottom slat 26,30. Spacers 34 are shown in FIGS. 2 and 3 and have rivets or screws holding the slats 26,30 together. A longitudinal slot 36 is left between overlapping slats 26,30 and the spacers 34 so gas passes upward through these slots 36 into the particulate material 32 which is moving in the direction shown by ←38. Thus the gas flow through the slots 36 is in the same direction as the movement of the particulate material and prevents fine particles passing down through the slots. As shown in FIG. 4, the overlap 40 and the underlap 41 of the adjacent slats 26,30 is approximately one-quarter of the narrowest width of the slat. This applies to tapered slats 26, whereas for the parallel slats 30 the overlap is one-quarter of the width of the slat.

Spacers 34 are provided at each end of the slats 26,30, and as shown in the drawings in the center of the slat. For longer slats more spacers 34 may be provided, and for shorter slats the middle spacer 34 may be omitted. FIG. 2 shows an inner fence 42 and an outer fence 44 that is curved to suit the radius of the conveyor. The fences 42,44 are of sufficient height to retain the particulate material 32 therein. In the case of a straight conveyor, as shown in FIG. 3, parallel fences 44 are shown on each side.

Figure 5:
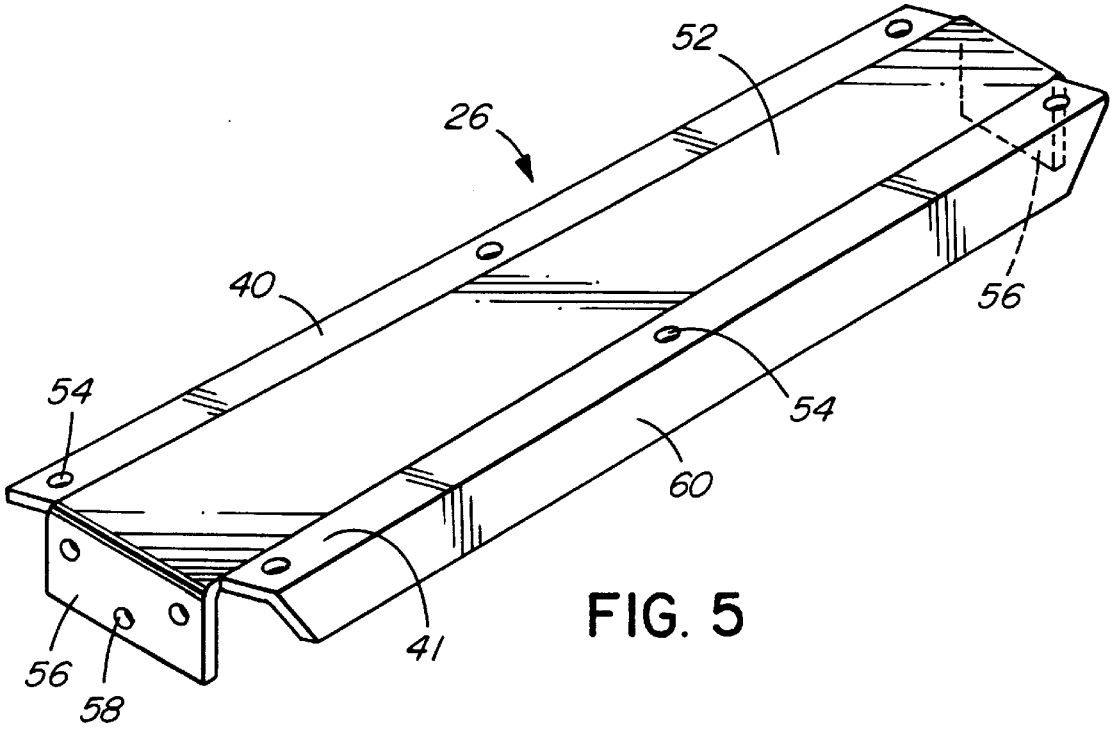
FIG. 5 is an isometric view showing a tapered slat for the conveyor of FIG. 2.
Figure 6:
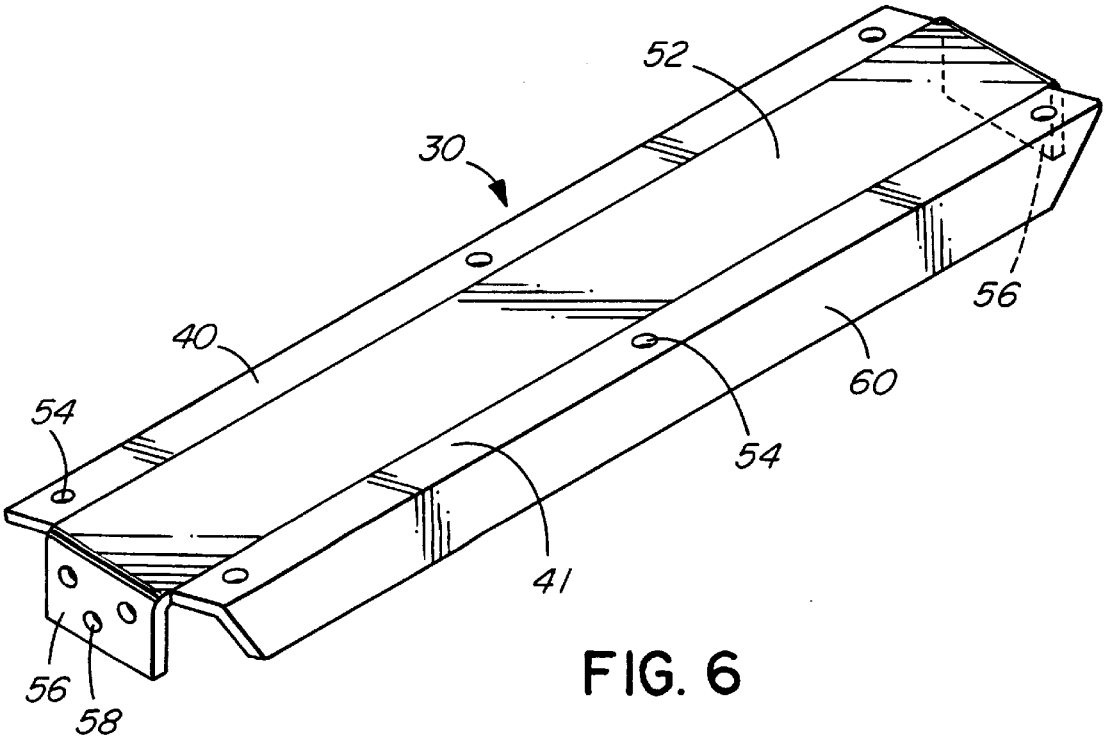
FIG. 6 is an isometric view showing a straight slat for the conveyor of FIG. 3.

Details of the slats are shown in FIGS. 5 and 6. FIG. 5 represents a tapered slat 26 and FIG. 6 represents a straight slat 30. As can be seen in FIG. 4, the overlap 40 of the slat and the underlap 41 are substantially parallel with a center portion 52 fitted between the overlap 40 and the underlap 41 representing the height of the spacer 34. Holes 54 in both the overlap 40 and the underlap 41 are for rivets or screws to hold the spacers 34 in place as shown in FIG. 4. End flanges 56 are shown at both ends of the slats 26,30. The end flanges 56 may not be necessary for some types of conveyors. The end flanges 56 have holes 58 therein for attachment to the fences 40,44,46. The end flanges 56 are shown directed downwards. Welded assemblies may be used in preferred designs.

A stiffener 60 is formed downward along the trailing edge of each slat 26,30. This arrangement provides gas flow through the slots 36 in the same direction that the particulate material moves on the conveyor.

The size of the slot 36 can determine gas flow. The spacers 34 can be different heights so that the slot size varies. Typically the spacer height is 0.100" (2.5 mm). However, the length of the slot 36 represents the length of each slat 26,30. Circulation of gas through the slot 36 can be varied by varying gas pressure and gas flow. Another variable is the sizes of the fine particles of material that are being conveyed and the requirement to which the conveyor is being used, i.e., as a dryer or as a filter. Sufficient gas is passed through the slots 36 to ensure that fine particles do not pass backwards through the slots 36 or are carried away in the gas stream.

Various changes may be made to the embodiments shown herein without departing from the scope of the present invention which is limited only by the following claims.

I claim:

1. A ventilated tray for conveying particulate material on a vibrating conveyor comprising:

a plurality of overlapping slats arranged transversely to the direction of travel of the particulate material on the conveyor, each slat having a leading edge and a trailing edge, and the slats being shaped to cooperate to form a generally planar surface over which particulate material is conveyed by vibratory motion of the slats;

adjacent slats overlapping in the direction of travel of the particulate material leaving transverse longitudinal slots at the leading edges of top slats for gas flow therethrough.

2. The ventilated tray according to claim 1 wherein the plurality of slats are tapered for a curved conveyor.

3. The ventilated tray according to claim 1 wherein the plurality of slats are parallel for a straight conveyor.

4. The ventilated tray according to claim 1 wherein the plurality of slats overlap by approximately one-quarter of the narrowest slat width.

5. The ventilated tray according to claim 1 wherein each of the plurality of slats has an overlap and an underlap which are in substantially parallel planes, and each of the plurality of slats has a connecting portion between the overlap and the underlap.

6. The ventilated tray according to claim 5 wherein each of the plurality of slats has a stiffening web at a trailing edge of the underlap extending substantially at right angles therefrom, the stiffening web assisting in directing gas flow through the longitudinal slots between the slats.

7. The ventilated tray according to claim 1 wherein end walls are provided to form fences at both ends of each of the plurality of slats.

8. The ventilated tray according to claim 7 wherein each of the plurality of slats has flanged ends for attachment to the end walls.

* * * * *